United States Patent [19]

Uehara

[11] 4,203,712

[45] May 20, 1980

[54] SINGLE OR PLURAL VARIABLE DISPLACEMENT PUMP CONTROL WITH AN IMPROVED FLOW METERING VALVE

[75] Inventor: Kazuo Uehara, Tokyo, Japan

[73] Assignee: Kabushiki Kaisha Komatsu Seisakusho, Tokyo, Japan

[21] Appl. No.: 892,305

[22] Filed: Mar. 31, 1978

[30] Foreign Application Priority Data

Mar. 31, 1977 [JP] Japan ..... 52-35397
Mar. 31, 1977 [JP] Japan ..... 52-35398
Mar. 31, 1977 [JP] Japan ..... 52-35399

[51] Int. Cl.[2] ..... F04B 49/00

[52] U.S. Cl. ..... 417/218; 60/447; 60/452

[58] Field of Search ..... 60/445, 447, 449, 451, 60/452; 417/216, 218, 219, 220, 221, 222

[56] References Cited

U.S. PATENT DOCUMENTS 3,732,036 5/1973 Busbey et al. ..... 417/216
3,841,795 10/1974 Ferre et al. ..... 417/216
3,963,378 6/1976 McMillan ..... 60/447 X
4,017,215 4/1977 Butler ..... 60/447 X

*Primary Examiner*—Carlton R. Croyle
*Assistant Examiner*—Edward Look
*Attorney, Agent, or Firm*—Armstrong, Nikaido, Marmelstein & Kubovcik

[57] ABSTRACT

A hydraulic control system for adjusting the displacement of a variable displacement pump or pumps as dictated by pump output pressure and input speed. Driven by the same prime mover as the pump or pumps is a charging pump which communicates with a restrictor adapted to create a differential in the output fluid pressure therefrom, which pressure differential is sensed by a sensing valve for providing a corresponding output fluid pressure. Servo control means provided to the variable displacement pump or pumps communicates with both the restrictor and the sensing valve for adjusting the pump displacement in response to the fluid pressures delivered therefrom. A flow metering valve assembly is connected in a bypass around the restrictor to permit the passage therethrough of the charging pump output fluid at a rate metered in accordance with the variable displacement pump output pressure.

6 Claims, 8 Drawing Figures

SINGLE OR PLURAL VARIABLE DISPLACEMENT PUMP CONTROL WITH AN IMPROVED FLOW METERING VALVE

BACKGROUND OF THE INVENTION

1. Field of the Invention

This invention pertains to hydraulic control systems, and is directed more specifically to a control system for automatically adjusting the displacement of a variable displacement hydraulic pump or pumps or for limiting the input torque thereof at a predetermined value.

2. Description of the Prior Art

A variety of hydraulic control systems have been suggested and used for automatically adjusting the displacement of a variable displacement pump or a plurality of such pumps driven by a common prime mover such as an internal combustion engine. Included in such control systems are input torque limiters whereby pump displacement is adjusted in accordance with pump output pressure so that the product of the pump displacement and the pump output pressure may be maintained at or close to a predetermined limit.

A well known example of the input torque limiters is of the cam type wherein a cam is actuated in accordance with pump displacement via a linkage system for correspondingly adjusting the force of a spring on a control valve which senses the pump output pressure. This cam type input torque limiter is objectionable in that the linkage system in use must be a highly complex and precision-made one. Moreover, for combined use of the torque limiter with a load sensing or cutoff control system, a still more complex and precision-made linkage system is needed for stabilized operation. A further objection is that the input torque limit of the pump under control is determined by the spring modulus of the control valve and by the contours of the cam and, therefore, cannot be easily re-adjusted or altered. As a consequence, in the case where the variable displacement pump is driven together with some other pump by a common prime mover, it is impossible to match prime mover output torque and pump input torque.

Another known input torque limiter is of the multiple-stage spring type, wherein the pump displacement is decreased linearly with an increase in the pump output pressure. In order to closely approximate the product of pump displacement and pump output pressure to a predetermined limit, the linearity characteristic is modified in accordance with the pump output pressure by the multiple-stage spring means. This second known example is unsatisfactory in control accuracy, however, and is also not readily adaptable for use with a load sensing or cutoff control system. Further, the input torque limit of the pump is determined by the modulus and the type of the spring means in use, thus preventing easy re-adjustment.

There has also been known a pump displacement control system which is responsive to prime mover speed, such that the pump displacement is decreased upon decrease in the pump speed. Although the pump input torque is not strictly maintained at a constant value, the speed responsive control system permits proper torque matching even in the case where the variable displacement pump is driven together with another pump by a common prime mover. An objection to this known control system, however, is that the pump speed varies with the pump output pressure. Especially in the use of a prime mover of low torque rise, the output power of the pump decreases with an increase in its output pressure. Moreover, the response of the system is comparatively poor because of the inertial forces of the prime mover.

These drawbacks result from unnecessarily great fluctuations of pump speed. In order to reduce such speed fluctuations, there has been suggested and used a system incorporating a summing valve as an auxiliary control mechanism, for limiting the total input torque of a plurality of variable displacement pumps. The summing valve helps to accomplish this objective only to such an extent, however, that unnecessary speed fluctuations cannot be eliminated altogether.

SUMMARY OF THE INVENTION

It is an object of this invention to provide an improved hydraulic control system for automatically adjusting the displacement of a single or a plurality of variable displacement pumps, such that the listed problems of the prior art can be thoroughly overcome.

Another object of the invention is to provide an automatic flow metering valve for use as an input torque limiter in the above control system, which valve is readily adaptable for use with either a single or a plurality of variable displacement pumps.

A further object of the invention is to provide a hydraulic control system including such a flow metering valve whereby the input torque of a variable displacement pump, or the total input torque of a plurality of such pumps, can be maintained at a preset limit more accurately than by the prior art, and whereby prime mover output torque and pump input torque can be easily matched for the most efficient operation.

A still further object of the invention is to provide a hydraulic control system so made that the pump input torque control characteristic of the system can be easily adjustably varied as required or desired.

In accordance with this invention, stated in brief, there is provided a variable displacement pump control system including restrictor means communicating with a fixed displacement pump and adapted to create a differential in the output fluid pressure therefrom. In response to this pressure differential, sensing valve means produces a corresponding output fluid pressure. The variable displacement pump under control is provided with servo control means which is in communication with both the restrictor means and the sensing valve means for adjusting the pump displacement in response to the fluid pressures therefrom. Also included in the control system is flow metering valve means which is connected in parallel with the restrictor means and which operates to provide a variable degree of opening therethrough in response to the output fluid pressure from the variable displacement pump.

Thus, as the output pressure of the variable displacement pump builds up to or in excess of a predetermined cracking pressure of the flow metering valve means, the output fluid from the fixed displacement pump is permitted to flow through the bypass around the restrictor means at a rate metered in accordance with the variable displacement pump output pressure. The input torque of the variable displacement pump is thus maintained constant as long as its output pressure does not drop below the cracking pressure of the flow metering valve means. In the subsequently presented embodiments of the invention, the flow metering valve means is disclosed as adapted for use with a single and a plurality of variable displacement pumps.

In a further embodiment, the control system additionally comprises flow control valve means connected in a second bypass formed around the parallel circuit of the restrictor means and the flow metering valve means. The flow control valve means permits ready adjustment of the rate of fluid flow through the second bypass, for correspondingly varying the pump input torque control characteristic of the system. As this flow control valve means is interlocked with the governor of the prime mover, for example, the prime mover output torque and the pump input torque can be automatically matched at various speed settings.

The above and other objects, features and advantages of this invention and the manner of attaining them will become more readily apparent, and the invention itself will best be understood, upon consideration of the following description of some preferred embodiments, with reference had to the accompanying drawings.

DESCRIPTION OF THE PREFERRED EMBODIMENTS

Figure 1:
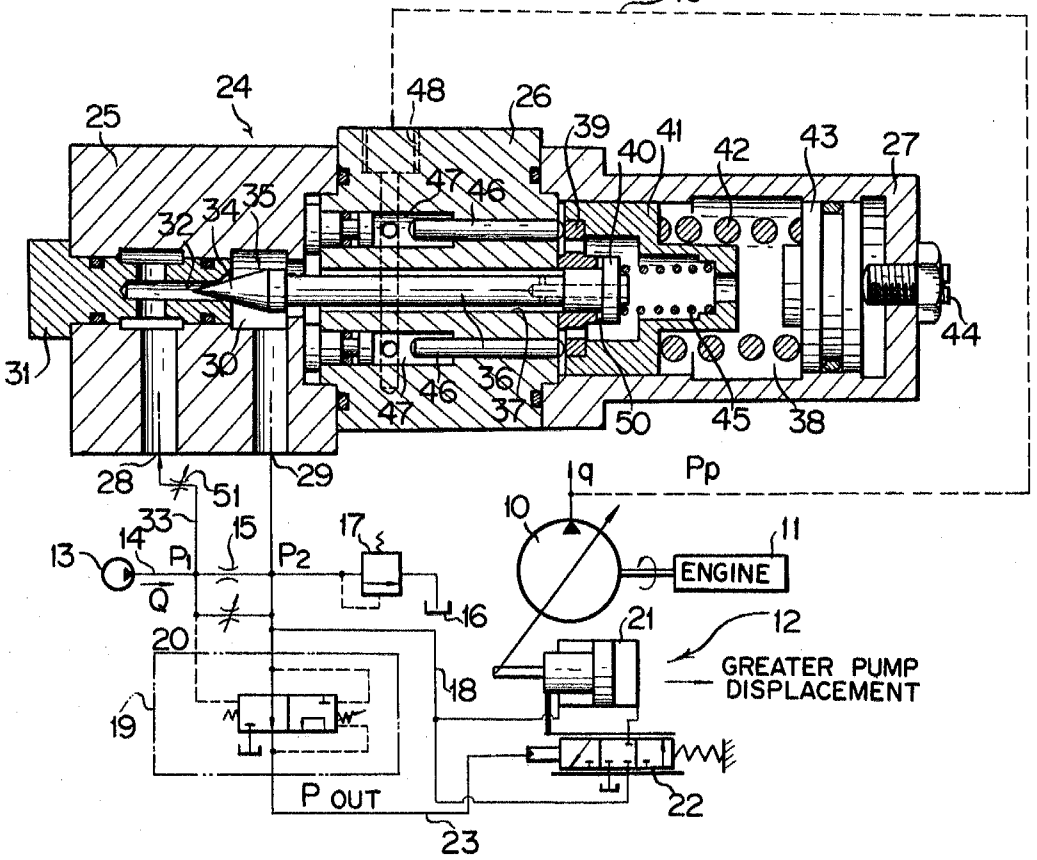
FIG. 1 is a schematic representation of the hydraulic control system for adjusting the displacement of a single variable displacement pump according to the principles of this invention, an automatic flow metering valve assembly in the control system being shown with parts in section.

The hydraulic control system in accordance with this invention is illustrated in FIG. 1 as adapted specifically for adjusting the displacement of, or controlling the input torque of, a single variable displacement hydraulic pump designated 10. This pump is driven directly by a prime mover such as an internal combustion engine 11. A servo control 12 is provided to the pump 10 for varying its displacement in response to fluid pressure signals delivered thereto, as hereinafter described in detail.

Shown at 13 is a fixed displacement pump or charging pump which is driven jointly with the variable displacement pump 10 by the engine 11. The output line 14 of the fixed displacement charging pump 13 is provided with a restrictor 15 of the fixed type intended to establish a pressure differential in the output fluid flow from the charging pump. On flowing out of the restrictor 15, the output fluid from the charging pump 13 is partly returned to a reservoir or sump 16 via a relief valve 17, partly delivered to the servo control 12 by way of a line 18, and partly delivered to the inlet port of a pressure differential sensing valve 19. Another restrictor 20 of the variable type is connected in parallel with the first recited restrictor 15.

The sensing valve 19 is shown as a normally open, two-position valve responsive to the pressure differential in the output fluid flow from the charging pump 13. The output fluid pressure from this sensing valve 19 can be defined as:

$$P_{out}=P_o+\alpha(P_1-P_2) \quad (1)$$

where $P_{out}$ is the output fluid pressure from the sensing valve 19; $P_o$ and $\alpha$ are constants; $P_1$ is the fluid pressure upstream of the restrictor 15; and $P_2$ is the fluid pressure downstream of the restrictor 15.

The servo control 12 is of prior art design comprising a hydraulic cylinder 21 of the double-acting, differential type having its rod end fluid chamber communicated with the line 18, and a three-position valve 22 for controlling communication between the line 18 and the head end fluid chamber of the servo cylinder 21. The valve 22 has its pilot line 23 in open communication with the outlet port of the sensing valve 19 and is therefore actuated by the output pressure $P_{out}$ therefrom to correspondingly control the communication between line 18 and servo cylinder 21.

As is well known, the servo control 12 of the above configuration adjusts the displacement of the variable displacement pump 10 so that:

$$q=\beta(P_{out}-P_o) \quad (2)$$

where q is the pump displacement, and $\beta$ is a constant. From Equations (1) and (2), the displacement of the pump 10, controlled as above, can be given as:

$$q=\alpha\beta(P_1-P_2) \quad (3)$$

The reference numeral 24 generally designates an automatic flow metering or throttling valve assembly which is incorporated in the control system as the pump input torque limiter and which constitutes one of the most pronounced features of this invention. The flow metering valve assembly 24 has a housing which is shown to be constituted of three interconnected sections 25, 26 and 27. The housing section 25 seen at the left in FIG. 1 has formed therein an inlet port 28 and an outlet port 29 which are in communication with the upstream and the downstream sides, respectively, of the restrictor 15.

Also formed in the valve housing section 25 is a bore 30 of varying diameter which is partly filled and pressure-tightly closed at one end by a plug 31. This plug also has formed therein a bore 32 for providing communication between the inlet and the outlet ports 28 and 29. It is thus seen that the housing section 25 provides a bypass 33 around the restrictor 15.

The bore 32 in the plug 31 is funnel-shaped at one end to permit partial intrusion of a conical head 34 of a valve member or spool 35 which operates to permit the output fluid from the charging pump 13 to flow through the bypass 33 at a metered rate. The bored plug 31 serves therefore as the valve seat of the flow metering valve assembly 24. The valve member 35 is formed to include a stem 36 extending rightwardly from the head 34 through a bore 37 in the middle section 26 of the valve housing and projecting into a spring chamber 38 defined by the right hand housing section 27.

The right hand end of the valve stem 36 slidably extends into and through a bore in a movable piston seat 39 and has a flange 40 fastened thereto for engaging the piston seat. The piston seat 39 is additionally engaged by a spring retainer 41 mounted in the spring chamber 38 for sliding motion in the axial direction of the valve member 35. A comparatively heavy compression spring 42 extends between the spring retainer 41 and another spring retainer 43 which is also slidably mounted in the spring chamber 38. The force of this compression spring 42 can be adjustably varied by an adjusting screw 44 in abutting engagement with the spring retainer 43. Another compression spring 45 extends between the flange 40 on the valve stem 36 and the spring retainer 41, as will be later referred to.

A plurality of, two in the illustrated embodiment, actuating pistons 46 are slidably fitted in respective bores formed in the middle housing section 26 so as to each extend parallel to the valve stem 36. The actuating pistons 46 have their right hand ends held in abutting engagement with the piston seat 39 within the spring chamber 38 and have their left hand ends projecting into respective pressure signal chambers 47 which are both in open communication with a pressure signal port 48 in the middle housing section 26. This signal port 48 communicates by way of a pilot line 49 with the variable displacement pump 10 for receiving therefrom a fluid signal of the pump output pressure $P_p$.

The force of the aforesaid compression spring 45 is such that while the piston seat 39 is held stationary in the illustrated position, the valve head 34 is thereby urged against the valve seat 31 to close the valve, only to such an extent that they will not be subjected to any undue wear. In the illustrated normal position of the flow metering valve assembly 24, moreover, a slight gap 50 exists between the piston seat 39 and the flange 40 on the valve stem 36.

Upon increase in the pressure $P_p$ of the fluid signal delivered from the variable displacement pump 10 to the pressure signal port 48 of the flow metering valve assembly 24, the actuating pistons 46 simultaneously slide rightwardly, pushing the piston seat 39 and the spring retainer 41 against the bias of the compression spring 42. As the signal pressure builds up to a preset cracking pressure $P_{pc}$ of this flow metering valve assembly 24, the piston seat 39 moves into contact with the flange 40 on the valve stem 36 and thus starts to cause the valve head 34 to move away from the valve seat 31. The cracking pressure $P_{pc}$ can be easily adjusted by turning the adjusting screw 44 on the end face of the right hand housing section 27.

OPERATION

Driven by the internal combustion engine 11, the charging pump 13 produces a charging fluid flow at a rate Q. As mentioned, the fluid flow from the charging pump 13, on emerging from the restrictor 15, is partly returned to the reservoir 16 via the relief valve 17, partly delivered to the servo control 12, and partly delivered to the pressure differential sensing valve 19. The degree of opening of the restrictor 15 can be suitably regulated by the variable restrictor 20 connected in parallel therewith.

The different fluid pressures $P_1$ and $P_2$ on the upstream and the downstream sides of the restrictor 15 act upon the sensing valve 19, causing same to produce the output fluid pressure $P_{out}$, as defined by Equation (1), for delivery into the pilot line 23 of the servo control valve 22. The servo control 12 operates to adjust the displacement of the variable displacement pump 10 in accordance with Equation (2). The thus-controlled displacement of the pump 10 is as defined by Equation (3).

Upon resultant increase in the output pressure $P_p$ of the variable displacement pump 10 to the predetermined cracking pressure $P_{pc}$ of the flow metering valve assembly 24, the latter is actuated as above to open the bypass 33 around the restrictor 15. As a consequence, the differential decreases between the fluid pressures $P_1$ and $P_2$ on the upstream and the downstream sides of the restrictor 15, resulting in a corresponding decrease in the displacement q of the variable displacement pump 10. It is thus seen that the input torque T of this pump (defined as $T=P_p \cdot q$) is held constant, at a value such that its output pressure $P_p$ is not less than the cracking pressure $P_{pc}$ of the flow metering valve 24.

The input torque T of the variable displacement pump 10 can be given as:

$$T \propto P_p \cdot q = \gamma\left(\frac{Q}{a_o}\right)^2 \frac{P_p}{\left(1+\frac{a^*}{a_o}\right)^2 \cdot P_{pc}} \tag{4}$$

where $\gamma$ is a constant; $a_o$ is the area of the flow path through the restrictor 15; and $a^*$ is the area of the flow path through the flow metering valve 24. This valve is therefore to perform the intended function as the input torque limiter of the variable displacement pump if the equation:

$$\frac{P_p}{P_{pc}} = \left(1+\frac{a^*}{a_o}\right)^2 \tag{5}$$

is satisfied.

It is particularly noteworthy in connection with the throttling valve 24 that the input torque of the variable displacement pump can be closely approximated to a preset maximum value merely as the head 34 of its valve member 35 is cone-shaped as shown. Thoretically, the approximation error is less than 1.5%, which is a surprisingly low value as compared with that of the prior art input torque limiter of the multiple-stage spring type. It will be evident that the illustrated control system readily lends itself for use in load sensing or cutoff control applications, as the output pressure $P_{out}$ of the pressure differential sensing valve 19 is delivered to a load sensing or cutoff control circuit.

Further, in the illustrated control system, the input torque of the variable displacement pump 10 can be defined as:

$$T = \frac{\gamma}{a_o^2} Q^2 \tag{6}$$

Therefore, as the variable displacement pump 10 and the fixed displacement pump 13 are driven by the common engine or other prime mover, the system performs the function of pump displacement control in response to prime mover speed.

Figure 2:
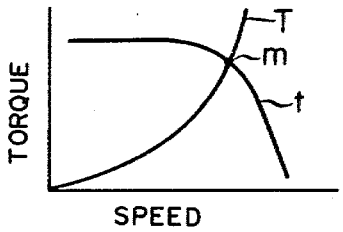
FIG. 2 is a graph plotting the curves of prime mover output torque and pump input torque against prime mover speed, the graph being explanatory of torque matching in the control system of FIG. 1.

FIG. 2 is a graph plotting the curves of the prime mover output torque t and the variable displacement pump input torque T against the speed of rotation. As the system is conditioned to perform the function of speed-responsive pump displacement control as above, the prime mover output torque can be easily matched with the pump input torque. The matching point is indicated at m in FIG. 2. The input torque limit can be determined by the area $a_o$ of the flow path through the restrictor 15 and by an adjusting restrictor 51, FIG. 1, that is connected between the restrictor 15 and the flow metering valve 24.

SECOND FORM

Figure 3:
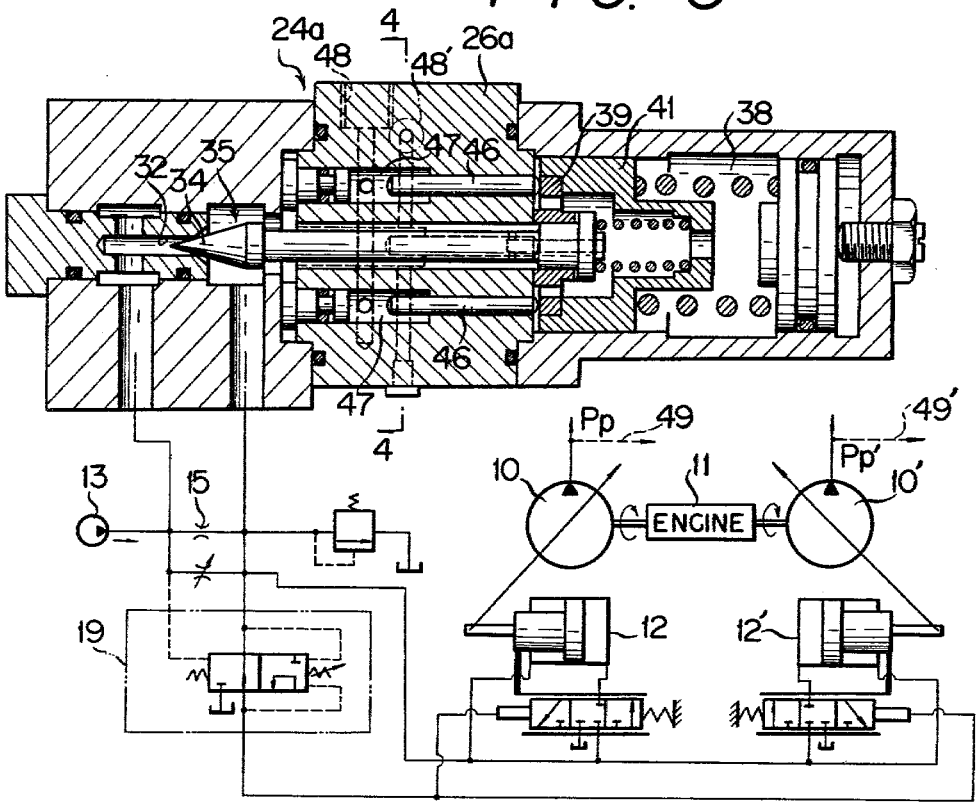
FIG. 3 is a representation similar to FIG. 1 but showing the control system as adapted for use with two variable displacement pumps.

The hydraulic control system of this invention is readily adaptable for use with a plurality of variable displacement pumps. FIG. 3 illustrates, by way of example, two variable displacement pumps 10 and 10' having their total input torque limited by the control system of the invention. Driven bya common prime mover such as the internal combustion engine 11, the pumps 10 and 10' are provided with, and have their displacement adjusted by, respective servo controls 12 and 12'.

Figure 4:
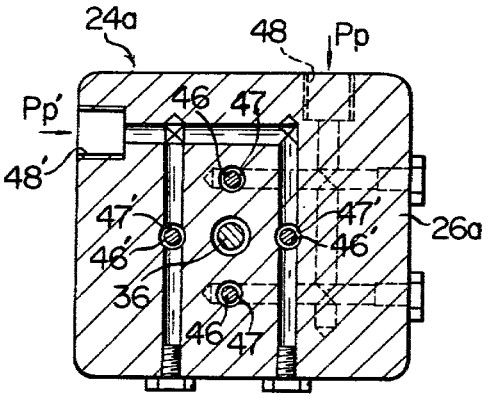
FIG. 4 is a sectional view of the modified flow metering valve assembly in the control system of FIG. 3, the section being taken along the line 4—4 in FIG. 3.

For limiting the total input torque of the pumps 10 and 10', the flow metering valve assembly 24 of FIG. 1 must be slightly modified in construction so that its valve member 35 may be shifted in response to the sum of the pump output pressures $P_p$ and $P_p'$ delivered as pressure signals to the valve by way of pilot lines 49 and 49'. The thus-modified throttling valve assembly is illustrated in FIGS. 3 and 4 and therein generally labelled **24*a***.

The modified flow metering valve **24*a* differs from the preceding example only in the construction of its middle section 26*a*, which has formed therein two pressure signal ports 48 and 48' which are in open communication, on one hand, with the pumps 10 and 10' by way of the pilot lines 49 and 49', respectively. On the other hand, the pressure signal port 48 is in open communication with the two pressure signal chambers 47, as in the preceding embodiment, and the other port 48' is in open communication with two additional pressure signal chambers 47'**.

Projecting into the above four pressure signal chambers 47 and 47', each at one end thereof, are actuating pistons 46 and 46', which have the other ends thereof held in abutting engagement with the piston seat 39 in the spring chamber 38. The four actuating pistons 46 and 46' are disposed at constant angular spacings about the axis of the valve member 35 so as to exert no torsional stress on the piston seat 39 and the spring retainer 41 in operation. The other details of construction of the control system are as set forth above in connection with FIG. 1.

It is evident from the foregoing that the valve member 35 of the modified flow metering valve assembly **24*a* is to be shifted in response to the sum of the output fluid pressures $P_p$ and $P_p'$ from the two variable displacement pumps 10 and 10'. The flow metering valve assembly 24*a* thus operates to meter the fluid flow through the bypass 33 around the restrictor 15**, as long as the sum of the fluid pressures $P_p$ and $P_p'$ is not less than the total cracking pressure of the valve. It will be seen that this control system readily lends itself for use with more than two variable displacement pumps.

THIRD FORM

Figure 5:
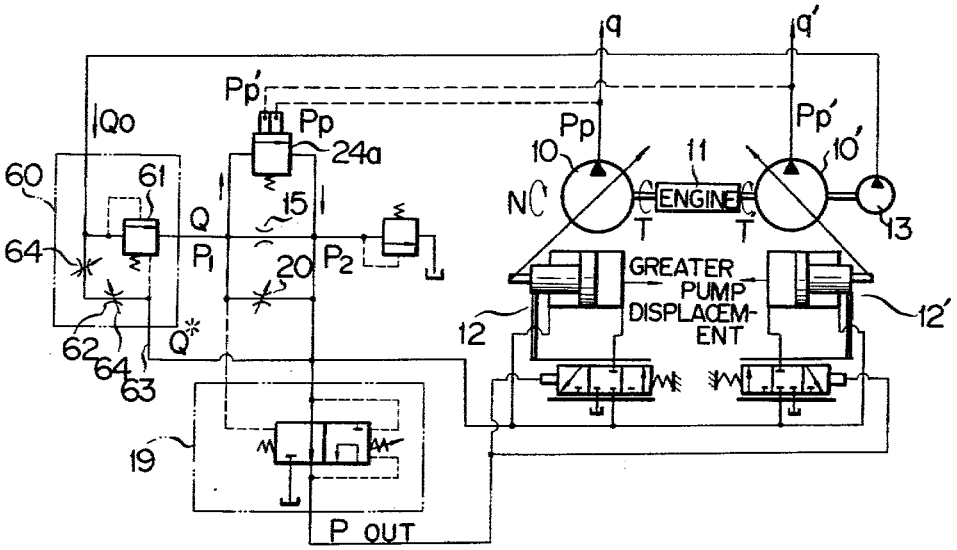
FIG. 5 is a schematic representation of a further preferred form of the control system according to the invention.

In a further preferred embodiment of the invention shown in FIG. 5, the control system is put to use with two variable displacement pumps 10 and 10' driven by the same internal combustion engine 11 and provided with the respective servo controls 12 and 12'. The control system further comprises the charging pump 13 also driven by the engine 11, the restrictors 15 and 20, the pressure differential sensing valve 19, the modified flow metering valve **24*a* (shown in FIG. 5** by the graphic symbol), and so on.

The control system of FIG. 5 is characterized by the inclusion of a flow control valve arrangement 60 comprising a compensator valve 61 connected between the charging pump 13 and the restrictor 15, and a flow control valve or restrictor 62 of the adjustable type connected in a bypass 63 around the compensator valve 61 and the parallel circuit of the restrictor 15 and the flow metering valve **24*a*. An adjusting restrictor 64 is further shown to be connected upstream of the flow control valve 62**.

In the control system of the foregoing configuration, the total input torque of the two variable displacement pumps 10 and 10' is:

$$T_t = T + T' P_p \cdot q + P_p' \cdot q' \tag{7}$$

where $T_t$ is the total pump input torque; T' is the input torque of the second variable displacement pump 10'; and q' is the displacement of the pump 10'. Therefore, as will be seen by referring to Equation (4):

$$T_t = \gamma\left(\frac{Q}{a_o}\right)^2 \frac{1}{\left(1 + \frac{a^*}{a_o}\right)^2 \cdot 2P_{pc}} (P_p + P_p') \tag{8}$$

where Q is the flow rate of the fluid delivered from the compensator valve 61 to the parallel circuit of the restrictor 15 and the flow metering valve **24*a***.

Since the flow metering valve **24*a*** satisfies the equation:

$$\frac{P_p + P_p'}{2P_{pc}\left(1 + \frac{a^*}{a_o}\right)} = 1 \tag{9}$$

the total input torque of the two variable displacement pumps 10 10' can be defined as:

$$T_t = \gamma\left(\frac{Q}{a_o}\right)^2 \tag{10}$$

The total input torque $T_t$ is therefore unaffected by the output pressures $P_p$ and $P_p'$ of the individual pumps 10 and 10'.

The total input torque $T_t$ can also be given as:

$$T_t = \gamma\left(\frac{Q_o - Q^*}{a_o}\right)^2 = \gamma\left(\frac{q_o}{a_o}\right)^2 \left(N - \frac{Q^*}{q_o}\right)^2 \tag{11}$$

where $Q_o$ is the flow rate, in cubic centimeters per minute, of the output fluid from the charging pump 13; Q* is the flow rate, in cubic centimeters per minute, of the fluid guided into the bypass 63 by the flow control valve arrangement 60; $q_o$ is the displacement of the charging pump in cubic centimeters per revolution; and N is the speed of the charging pump in revolutions per minute. It is thus seen that the total input torque control characteristic of the pumps 10 and 10' can be readily modified as desired by varying the bypassed fluid flow rate Q* through adjustment of the flow control valve 62 or of the spring force of the compensator valve 61.

Figure 6:
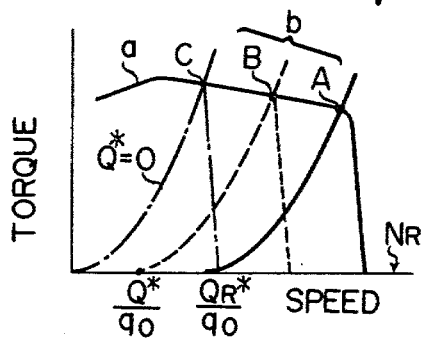
FIG. 6 is a graph explanatory of the matching of prime mover output torque and pump input torque in the control system of FIG. 5.

An adjusting lever 64 on the flow control valve 62 of the valve arrangement 60 may be suitably linked to the governor control lever, not shown, of the engine 11. It is possible in this manner to realize optimum matching of engine output torque and pump input torque, as will be seen from the following explanation of the graph of FIG. 6.

In this graph, the curve a represents the engine output torque, and the curves b represents the pump input torque. If the unshown governor is set for rated engine speed, the flow control valve 62 will be correspondingly adjusted to set the bypassed fluid flow rate at $Q_R$*, with the result that the engine output torque matches with the pump input torque at a point A in the graph. This matching point usually corresponds to the maximum horsepower point of the engine.

As the governor is set for lower speeds (e.g., 75% and 50% of the rated engine speed), the flow control valve 62 will be automatically readjusted to make the bypassed fluid flow rate Q* correspondingly lower than the rate $Q_R$* at the rated engine speed. In such cases, too, the engine output torque will match with the pump input torque at optimum points indicated at B and C in FIG. 6.

Figure 7:
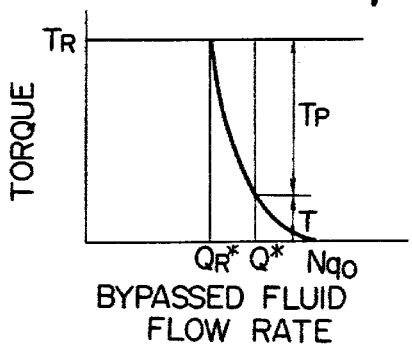
FIG. 7 is also a graph explanatory of torque matching in the case where a hydraulic pump having priority is driven together with the variable displacement pump by the same prime mover in the control system of FIG. 5.

FIG. 7 is explanatory of torque matching in the case where a hydraulic pump having priority is driven by the same engine as the variable displacement pumps. The flow control valve arrangement 60 is adjusted so that the bypassed fluid flow rate Q* may increase in accordance with the input torque $T_p$ of the priority pump, and the total input torque is held constant. The bypassed fluid flow rate Q* is made higher than $Q_R$* so that the sum of the priority pump input torque $T_p$ and the variable displacement pump input torque may be constant ($T_R$).

Figure 8:
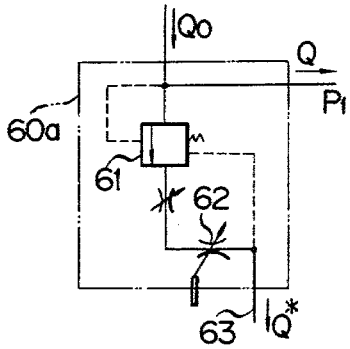
FIG. 8 is a schematic representation of a modification of a flow control valve arrangement in the control system of FIG. 5.

The flow control valve arrangement 60 of FIG. 5 may be modified as shown in FIG. 8. In the modified valve arrangement **60*a*, not only the flow control valve 62 but also the compensator valve 61 is connected in the bypass 63 around the parallel circuit of the restrictor 15 and the flow metering valve 24*a***.

While the variable displacement pump control system of this invention has been shown and described in terms of but a few of its possible forms, it will of course be understood that they are by way of example only and are not to be taken in a limitative sense. Numerous other embodiments of the invention will occur to those skilled in the art without departing from the spirit and scope of the invention as set forth in the following claims.

What is claimed is:

1. A hydraulic control system for a variable displacement hydraulic pump driven by a prime mover, comprising in combination:

a fixed displacement hydraulic pump;

restrictor means communicating with the fixed displacement pump and effective to create a differential in the output fluid pressure therefrom;

sensing valve means for sensing the pressure differential created by the restrictor means and for providing an output fluid pressure corresponding thereto;

servo control means communicating with the restrictor means and with the sensing valve means for adjusting the displacement of the variable displacement pump in response to the fluid pressure therefrom; and flow metering valve means connected in parallel with the restrictor means and effective to provide a variable degree of opening therethrough in response to the output fluid pressure from the variable displacement pump, said flow metering valve means comprising:

a valve seat;

a valve member having a conical head coacting with the valve seat to provide said variable degree of opening;

spring means normally urging the conical valve head against the valve seat to hold the opening closed;

actuating means movable against the force of the spring means in response to the output fluid pressure from the variable displacement pump; and means for operatively connecting the actuating means to the valve member when the former is moved to a predetermined degree against the force of the spring means;

whereby the conical valve head moves away from the valve seat when the actuating means is moved to more than the predetermined degree against the force of the spring means.

2. The hydraulic control system as recited in claim 1, wherein the fixed displacement pump is driven by the same prime mover as the variable displacement pump.

3. The hydraulic control system as recited in claim 1, wherein the actuating means comprises a plurality of pistons arranged parallel to each other.

4. The hydraulic control system as recited in claim 3, wherein the valve member includes a stem having the conical head formed on one end thereof, and wherein the operatively connecting means comprises:

a piston seat slidably fitted over the valve stem, the actuating pistons being arranged for abutting contact with the piston seat each at one end thereof; and a flange formed on the other end of the valve stem for engagement with the piston seat, there being normally a gap between the flange and the piston seat.

5. A hydraulic control system for a plurality of variable displacement hydraulic pumps driven by a common prime mover, comprising in combination:

a fixed displacement hydraulic pump;

restrictor means communicating with the fixed displacement pump and effective to create a differential in the output fluid pressure therefrom;

sensing valve means for sensing the pressure differential created by the restrictor means and for providing an output fluid pressure corresponding thereto;

a plurality of servo controls each communicating with the restrictor means and with the sensing valve means for adjusting the displacement of one of the variable displacement pumps in response to the fluid pressures therefrom; and flow metering valve means connected in parallel with the restrictor means and effective to provide a variable degree of opening therethrough in response to the sum of the output fluid pressures from the variable displacement pumps, said flow metering valve means comprising:

a valve seat;

a valve member having a conical head coacting with the valve seat to provide said variable degree of opening;

spring means normally urging the conical valve head against the valve seat to hold the opening closed;

actuating means movable against the force of the spring means in response to the output fluid pressure from the variable displacement pump; and means for operatively connecting the actuating means to the valve member when the former is moved to a predetermined degree against the force of the spring means;

whereby the conical valve head moves away from the valve seat when the actuating means is moved to more than the predetermined degree against the force of the spring means.

6. The hydraulic control system as recited in claim 5, further comprising:

a bypass around the parallel circuit of the restrictor means and the flow metering valve means; and flow control valve means for adjustably varying the rate of fluid flow through the bypass.

* * * * *